US005661937A

United States Patent [19]

Doppler et al.

[11] Patent Number: 5,661,937

[45] Date of Patent: Sep. 2, 1997

[54] MEZZANINE FLOOR PANEL

[75] Inventors: Gregory E. Doppler, Loveland, Ohio; Donald J. French, Louisville, Ky.

[73] Assignee: Johnson-Doppler Lumber, Cincinnati, Ohio

[21] Appl. No.: 423,159

[22] Filed: Apr. 17, 1995

[51] Int. Cl.[6] ..... E04B 5/02

[52] U.S. Cl. ..... 52/410; 52/408; 52/592.4; 52/506.01

[58] Field of Search ..... 52/592.4, 783.11, 52/783.19, 408, 410, 506.01

[56] References Cited

U.S. PATENT DOCUMENTS

| | | | |
|---|---|---|---|
| 1,986,739 | 1/1935 | Mitte . | |
| 2,266,746 | 12/1941 | Elmendorf . | |
| 2,861,525 | 11/1958 | Curtis et al. . | |
| 3,388,516 | 6/1968 | Thielen | 52/408 |
| 3,579,941 | 5/1971 | Tibbals | 52/592.4 X |
| 4,061,813 | 12/1977 | Geimer et al. . | |
| 4,076,873 | 2/1978 | Shea . | |
| 4,173,248 | 11/1979 | Roberts . | |
| 4,209,433 | 6/1980 | Hse . | |
| 4,236,365 | 12/1980 | Wheeler . | |
| 4,242,406 | 12/1980 | El Bouhnini et al. | 428/236 |
| 4,290,248 | 9/1981 | Kemerer et al. . | |
| 4,361,612 | 11/1982 | Shaner et al. . | |
| 4,407,771 | 10/1983 | Betzner et al. . | |
| 4,567,215 | 1/1986 | Jackson . | |
| 4,609,305 | 9/1986 | Groeneveld | 52/408 X |
| 4,612,748 | 9/1986 | Arnold et al. | 52/309.16 |
| 4,641,469 | 2/1987 | Wood . | |
| 4,992,519 | 2/1991 | Mukherjee . | |
| 5,028,286 | 7/1991 | Hsu . | |
| 5,161,342 | 11/1992 | Hasan et al. | 52/408 X |
| 5,182,892 | 2/1993 | Chase . | |
| 5,230,959 | 7/1993 | Young, Sr. et al. . | |
| 5,335,473 | 8/1994 | Chase . | |

OTHER PUBLICATIONS

Redex™, Sierra Pacific Industries, Inc., Humboldt Flakeboard Division, 6 pages.

*Primary Examiner*—Wynn E. Wood
*Assistant Examiner*—Timothy B. Kang
*Attorney, Agent, or Firm*—Wood, Herron & Evans L.L.P.

[57] ABSTRACT

A mezzanine floor includes a corrugated metal base with tongue and groove panels secured thereto, wherein the panels have been finished with a number of steps to achieve a combination of desired features, including durability, cleanability, water resistance and non-skid characteristics. The finishing steps include coating and curing a polyester acrylic layer, followed by coating and semi-curing at least one more layer of acrylic with no polyester. Then, a final layer of acrylic is coated and all of the layers are cured via electron beam and then ultraviolet radiation. The viscosity of the acrylic is varied during the successive coatings, and this produces the textured finish necessary for non-skid characteristics. The tongue and groove configuration is offset to enhance stability at the joints between adjacent panels. The combination of the textured and durable surface finish, the internal cohesiveness of the panels and the tongue and groove also enables the panels to be installed at reduced cost, either via screws with reduced size heads or by gluing.

6 Claims, 2 Drawing Sheets

MEZZANINE FLOOR PANEL

FIELD OF THE INVENTION

This invention relates to a mezzanine floor, and more particularly to a mezzanine floor panel which results in a mezzanine floor with advantageous durability, cleanability, water resistance and non-skid characteristics. One aspect of the invention relates to reduced costs in installing the panels.

BACKGROUND OF THE INVENTION

Mezzanine floors are often used in industrial environments, such as in warehouses, to provide uniformity in surface wear and structural integrity for relatively large areas which must undergo heavy traffic, particularly wheel-borne heavy loads. A typical mezzanine floor includes an underlying support layer of corrugated sheet metal, preferably 18 to 20 guage, and the corrugated metal is rigidly connected, or secured, to a building frame. The manner of securement depends upon whether the floor is located at ground level or at another level, such as a second or third floor, as in a modular storage deck used in a warehouse. The corrugated metal may be secured to vertical and/or horizontal structural support beams of various shapes and sizes. A single building may have a number of mezzanine floors.

An upper layer of panels is secured to the layer of corrugated metal by holding screws, and the top surfaces of the panels form the top surface of the mezzanine floor. These holding screws extend downwardly from the top surfaces of the panels, through the panels and into the relatively flat upper portions of the corrugated metal, for securement thereto. The panels are usually supported laterally by tongue and groove interconnections, which help interlock the panels to promote continuity of the floor and transfer wheel loads from panel to panel. Preferably, the tongue and groove between adjacent rows of panels reside above the flat upper portions of the corrugated metal.

In mezzanine floors of this type, the panels must be sufficiently sturdy to hold up against the heavy wheel loads common to industrial use, without delamination or without allowing any sudden punch through above the voids, or troughs, of the corrugated metal.

Another important characteristic of mezzanine flooring panels is uniformity in thickness and in surface conditions, within relatively tight tolerance ranges. In addition to being an indication of poor workmanship or design, such variations can create a hazardous condition for wheeled hand trucks, or any other wheel-supported material handling device, as well as a tripping hazard for pedestrian traffic.

Similar to any construction of a building or support structure, it is desirable to manufacture and install the panels of a mezzanine floor as inexpensively as possible.

Due largely to these factors, most mezzanine floors have utilized panels of wood-based construction, using one or more of the following wood based components: wood chips, wood strands, wood plies, etc. Wood has good structural strength characteristics, and it is also very workable in a manufacturing context.

While wood-based boards have proved acceptable, each type of wood-based panel is susceptible to one or more disadvantages. For instance, plywood is susceptible to delamination. The exposed upper surface of oriented strand board eventually flakes which creates a coarse, pitted surface, and the board is susceptible to wheel punch under heavy wheel loads. Other types of composite board are also susceptible to delamination and core failure.

For composite panels, the internal cohesive strength of the panel components must also be very high. Otherwise, the panels will be subject to wheel punch through or breaking apart under wheel loads. However, if the internal cohesiveness of the panels is too high, it is extremely difficult to install and accurately seat the holding screws, unless the panels are first counterbored. This extra counterboring step increases the labor steps necessary for installing the mezzanine floor, and the installation job is already labor intensive enough without the need to perform additional steps.

In addition to structural integrity, mezzanine panels must have a wear surface which is water resistant, durable, cleanable and which has non-skid characteristics. To achieve one or more of these features, it is known in the industry to treat, or finish, the surfaces of the panels prior to installation. However, such treatments can become rather expensive, and in many cases, a treatment which is beneficial for one particular feature can have adverse results with respect to a different feature.

For instance, a surface finishing treatment designed to improve non-skid characteristics may produce bumps or dimples on the floor which do in fact provide the desired non-skid feature. However, such bumps or dimples may make the floor extremely hard to clean effectively on a regular basis.

It is an object of this invention to overcome the limitations of prior mezzanine panels used in prior mezzanine floors. More particularly, it is an object of this invention to improve upon the structural integrity, the durability, the cleanability, the water resistance and the non-skid characteristics of a mezzanine floor, without significantly increasing manufacturing or finishing costs for the panels, without increasing installation steps or difficulties, and without raising environmental concerns.

It is another object of the invention to reduce the costs associated with, and to simplify, the installation of a mezzanine floor.

SUMMARY OF THE INVENTION

This invention meets the above-stated objects and others by providing a homogenous high density, phenolic resin particle board, which produces a finished panel with advantageous durability, cleanability, water resistance, resistance to warpage, and anti-skid characteristics. Also, the finished panels have such high structural integrity that the installation procedure for the panels may be simplified, resulting in lower installation costs for the mezzanine floor.

These features result from the homogenous composition of the panels and the finishing steps which produce a textured top surface for the finished panels. Generally, the steps include two or more applications of an acrylic coating to the surfaces of the panels, followed by curing treatments. To achieve the textured top surface, the viscosity of the acrylic coating is lowered for the last of the applications, before final curing.

Because of the durability of the treated surface and the high internal cohesive properties of the preferred high density particle board, the panels may be held to the corrugated layer with screws having a smaller head diameter and a correspondingly steeper support structure underneath the head. With wide headed screws which have a flatter angled support, it is often difficult during installation to completely recess the top ends of the screws, so that they reside below the surface of the installed panels, as required by building codes.

The panel of this invention in a presently preferred embodiment is a homogenous product with no core voids or structural weak spots. The outstanding internal bond and lack of layers make delamination of the panel extremely unlikely. The surface hardness properties of the inventive panel distributes wheel loads over a larger surface area than prior designs. The panel's density and superior face and edge screw holding capabilities keep the wearing surface securely fastened to an underlying corrugated metal deck. The panel is constructed with phenolic resins, and, therefore, formaldehyde emissions are well within federal and other regulatory standards.

According to a preferred embodiment of the invention, a top surface of a high density composite particle board of Wood chips, phenolic resin and wax emulsion is sanded to achieve uniformity in calibration, or thickness. The panel is then discharged electrostatically with ionizing air and brushed clean. Thereafter, a polyester acrylic coating is applied, and the coating is treated with ultraviolet radiation to cure and cross-link the polymer.

Subsequently, the top surface is again sanded, electrostatically discharged and brushed clean. An acrylic coating is then applied to the top surface, without polyester, and then another coating of the same material is applied, preferably at a higher viscosity. These coatings are treated with ultraviolet radiation to semi-cure the acrylic.

A third coating of the same acrylic is then applied to the top surface, but the viscosity of the acrylic is reduced for this third coating, below the viscosity of the second acrylic coating. This viscosity change is achieved by adding a radiation sensitive monomer to the acrylic. The top surface is then treated with electron beam radiation. Immediately thereafter, the top surface is treated with ultraviolet radiation for a third and final time to completely cure the coatings on the surface.

This series of steps produces the desired features for a top surface of a mezzanine panel. More particularly, the variations in viscosity during the three acrylic coating steps produce a textured, or stippled, surface for the panels, with a textured finish that provides advantageous non-skid features and good cleanability, in addition to the other desired features.

The same treatment steps are performed on the other surface of the panels, i.e., the surface which will be the bottom, except that the viscosity changes are not necessary because there is no need for texturing on the bottom surface of the floor. However, applicant has learned that the surface treatments on both surfaces are necessary to prevent warpage. Preferably, the bottom surface is treated before the top surface.

The last treatment step involves running the surface treated panels through a fletcher machine to cut a tongue and a groove into opposite edges thereof. Another aspect of this invention involves the shape and configuration of the tongue and groove. More specifically, the tongue and the groove are vertically and horizontally offset to promote panel to panel wheel load transfer and to allow for a slight degree of linear expansion that occurs with moisture changes in wood-based panels. An ancillary benefit also results from this tongue and groove shape. Namely, at the job site, it is much easier for the installers to visually distinguish the top surface from the bottom surface. This minimizes the possibility of erroneous installation of the panels.

Because of the high durability of the surface treatment, the high internal cohesiveness of the panels, and the strength at the joints due to the tongue and groove configuration, this invention eliminates the susceptibilty to flaking and staining of the floor as in prior designs. This allows the panels of this invention to be installed in a manner which, previously, would not have been considered workable by others in this industry.

More specifically, this combination of features enables the panels to be adhered to the corrugated metal with adhesive. Previously, this was not done because eventual delamination or flaking would result in wearing away of the upper portions of the panels, leaving the adhered bottom portions, which could only be removed from the corrugated metal, if at all, after a significant amount of scraping, chiselling, or prying. The mezzanine floor of this invention is not susceptible to flaking or delamination.

By adhering the panels of this invention to the corrugated metal, the labor intensive step of fastening the panels to the corrugated metal with screws has been eliminated or rendered optional. Again, this aspect of the invention reduces the costs of installing a mezzanine floor.

These and other features of the invention will be more readily appreciated in view of the following detailed description and the drawings.

DETAILED DESCRIPTION OF THE INVENTION

Figure 1:
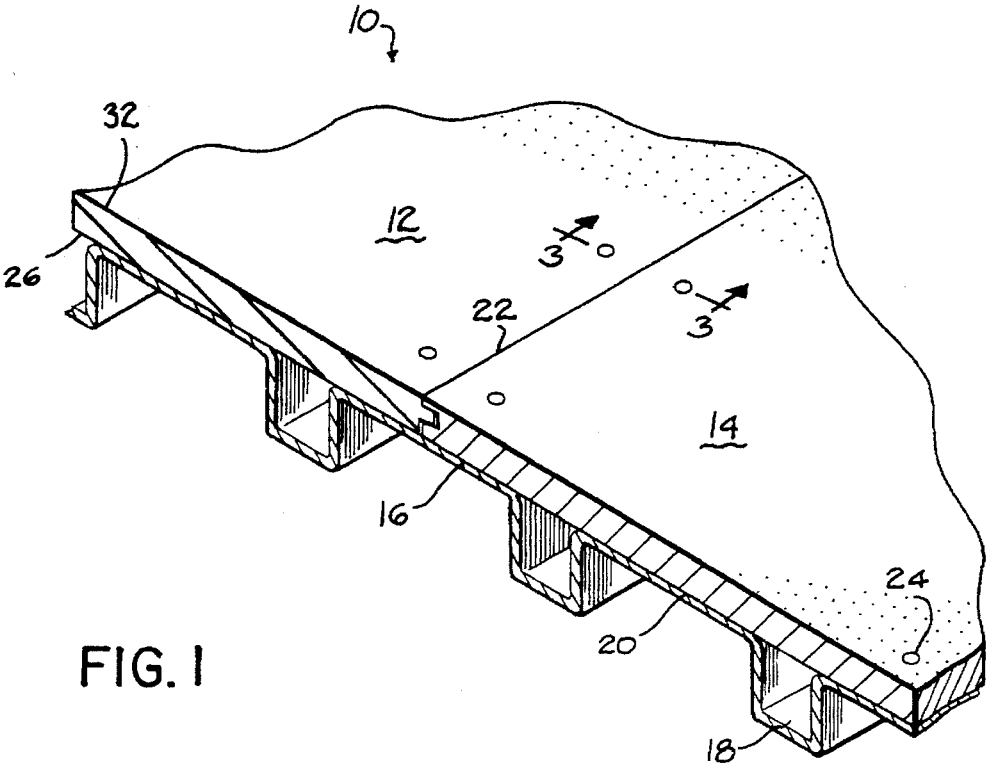
FIG. 1 is a perspective view, partially broken away, of a mezzanine floor utilizing panels finished in accordance with a preferred embodiment of the invention.

FIG. 1 shows, in cutaway view, a mezzanine floor 10 comprising an upper layer of a plurality of mezzanine panels 12 finished in accordance with the preferred embodiment of the invention. More specifically, FIG. 1 shows two adjacently located panels, designated by reference numerals 12 and 14, with a tongue and groove interconnection therebetween. A corrugated metal layer 16 supports the panels 12 and 14 and the rest of the panels comprising the upper portion of the mezzanine floor 10. The corrugated layer 16 includes troughs, or recesses, 18 and flat upper portions 20. FIG. 1 also shows a joint, or seam, 22 formed along the intersection between the adjacently located panels 12 and 14. Preferably, the joints 22 reside along the flat upper portions 20 of the corrugated metal 16. However, if by chance a joint 22 resides above a trough 18, the adjacently located panels 12 should be supported thereover by a shim (not shown).

Figure 2:
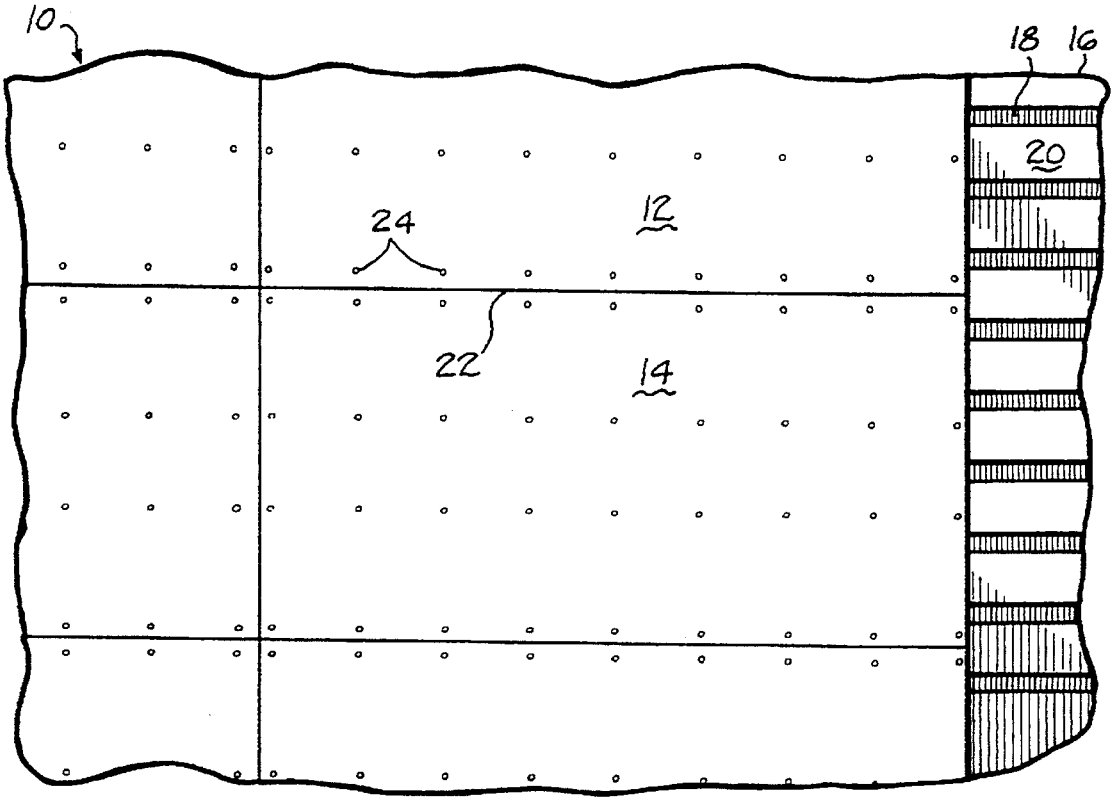
FIG. 2 is a top view of the primary components of a mezzanine floor, and a single mezzanine panel secured to underlying corrugated metal.

FIG. 2 shows a plan view of one mezzanine panel 12 secured to the corrugated metal 16 via screws 24, in accordance with a first preferred embodiment of the invention. As shown in FIG. 2, the panel 12 is preferably four feet in width by eight feet in length, with a thickness of ¾", although the invention contemplates variation in the length, width and thickness dimensions of the panels. Also, the tongues and grooves preferably extend along the longitudinal edges of the panels 12.

The invention relates to a series of finishing steps which form part of the manufacturing process for the mezzanine panels used in the mezzanine floor 10. While these finishing steps would be suitable for finishing various types of panel constructions, the preferred embodiment of the invention involves the use of composite panels 12 made primarily of highly compressed wood fibers, phenolic resin and a wax emulsion. Applicant has used a particle board sold by Rodman Industries, of Marinette, Wisconsin, under the name RESINCORE I. RESINCORE I is a phenolic particle board which is free of urea-formaldahyde, and which is water resistant. This product is sold in three versions, depending upon the density and pounds per cubic foot. More specifically, this product is sold under the designations #45, #55 and #62, which have densities of 47.5 pounds per cubic feet, 57.5 pounds per cubic feet and 62 pounds per cubic feet, respectively. Rodman Industries also makes a variation of the RESINCORE I product, and this variation has proved to be the preferred starting material for performing the steps of this invention. Namely, the preferred particle board is sold by Rodman Industries under the trademarks RESINCORE I-HP, 45 L4 and RESINCORE I-HP, 62 L4, depending on the density of the product.

The invention comprises a number of finishing steps performed on this particle board to achieve the desired combination of advantageous characteristics, or features. These steps are preferably performed as the panels 12 move along a conveying apparatus (not shown). One particularly suitable apparatus for finishing the panels 12 is a conveyor almost 400 feet in length which may be adapted as needed to perform finishing steps for boards or panels for various applications. The conveyor moves the panels 12 at relatively high speed, i.e. about four minutes for the entire length.

According to this invention, using this machine, a first or bottom surface 26 of a mezzanine panel 12 is initially sanded using three separate sanding heads, with successively finer finishes using a machine referred to as a TIMESAVER 352-HD. This three head sanding step results in a finish for the panel 12 which is preferably in the range of 180 to 280 grit, and preferably about 220 grit. This sanding step also enhances the thickness and uniformity for the panel 12, preferably within a tolerance of plus or minus 0.003 inches.

The first surface 26 of the panel 12 is then cleaned. This involves, initially, statically discharging the first surface via the use of ionizing air. The ionizing air is applied to a substantially enclosed casing located along the conveyance path. After electrostatically discharging the first surface 26, the first surface 26 is brushed clean.

Next, the panel 12 undergoes a fill operation. More specifically, a polyester acrylic **26*a* is applied to the first surface 26 via a roll coater with a reversing head. A suitable reversing coater is commercially available from the DuBois Machine Company of Jasper, Ind. Although any one of a number of different polyester acrylic fillers may be used, applicant has learned that a commercially available polyester acrylic fill sold by the Lawrence David Company under the designation PE707 has proved suitable. The temperature and viscosity of the polyester acrylic filler preferably are maintained constant during this operation, at a temperature of 105° F. and a viscosity of about 28,000 centipoise. Thereafter, the first surface 26 of the panel 12** is exposed to ultraviolet radiation. This crosslinks and cures the polyester in the coating.

With the polyester acrylic coating **26*a* cured in place on the first surface 26, the first surface 26** is again sanded, electrostatically discharged and then brushed clean.

Thereafter, a straight acrylic fill **26*b* is applied to the first surface 26** with a reverse coater similar to that used in the polyester acrylic coating, and then this step is performed at least a second time to produce a layer at a successive stage along the conveying apparatus. While a number of various acrylic fills would be suitable, applicant has learned that a commercially available acrylic fill has proved suitable for this invention. Again, the acrylic fill sold by PPG Industries under the designation R909Z-2 is maintained at a temperature of 105° F. and a viscosity of about 28,000 centipoise during application.

After the one or more coatings of acrylic fill, the first surface 26 is exposed to UV radiation to semi-cure the acrylic coatings. This provides a rigid base for the third and final coating **26*c* of acrylic, which is applied to this first surface 26** subsequent to the semi-curing ultraviolet treatment.

After this third coating **26*c* of acrylic which is preferably accomplished at 105° F. and a viscosity of about 28,000 centipoise, the first surface 26 is treated with electron beam radiation, and immediately after the electron beam radiation, the first surface 26** is treated with ultraviolet radiation for a third and final time. This completes curing of all the previously applied coatings.

At this point, panel 12 has been on the conveying apparatus for about four minutes. This completes treatment of the first surface 26.

Subsequently, the panels 12 are turned over and run through the conveying and treating apparatus to treat the second surface 32. As described, the first surface 26 will eventually become the bottom surface of the panel 12 when secured to the corrugated metal 16. For the second surface 32 of the panel 12, which will become the top surface, the treatment steps are almost identical. Applicant has learned that it is necessary to treat both surfaces 26 and 32 of the panels 12 in a similar manner. Otherwise, the resistance to warpage will be unequal on opposite sides of the panel 12, and the panel 12 tends to curl on the panel surface deficient in coatings.

During treatment of the second surface 32, the finishing steps vary from that of the first surface in that the viscosity of the acrylic is changed. More specifically, preferred viscosity ranges for the three coatings of acrylic are, 12–20 k centipoise and 25–30 k centipoise for the coatings prior to semi-curing **32*a* and 32*b*, respectively, followed by a final coating 32*c* of 15–25 k centipoise. Also, the second coating 32*b* of acrylic preferably has a higher viscosity than the first coating 32*a*, and the third, final coating 32*c* has a lower viscosity than the second coating 32*b*, but higher than the first 32*a***. Despite these variations in viscosity, the application temperature for the acrylic remains at 105° F. These viscosity changes are caused by adding a radiation sensitive monomer, preferably a commercially available Hexanediol Diacrylate sold by Radcure under the designation HDODA. By using this additive, preferably in the range of five to ten percent by volume, the viscosity of the acrylic can be varied as desired. Preferably, the viscosity is measured to assure that the desired range is maintained during operation.

This variation in viscosity provides the desired texture for the second surfaces 32 for the mezzanine panels 12 of this invention. The textured surface results from the use of a differential coater, which is essentially a reverse coater with the reversing roller removed. A differential coater suitable for this process is commercially available from Black Brothers, Inc. of Mendota, Ill. This textured surface has advantageous durability, cleanability, water resistance and non-skid characteristics. The second surface 32 includes a relatively uniform distribution of stipples (not shown), to enhance the non-skid characteristics, but these stipples are not so pronounced as to adversely affect the cleanability of the panels 12.

Figure 4:
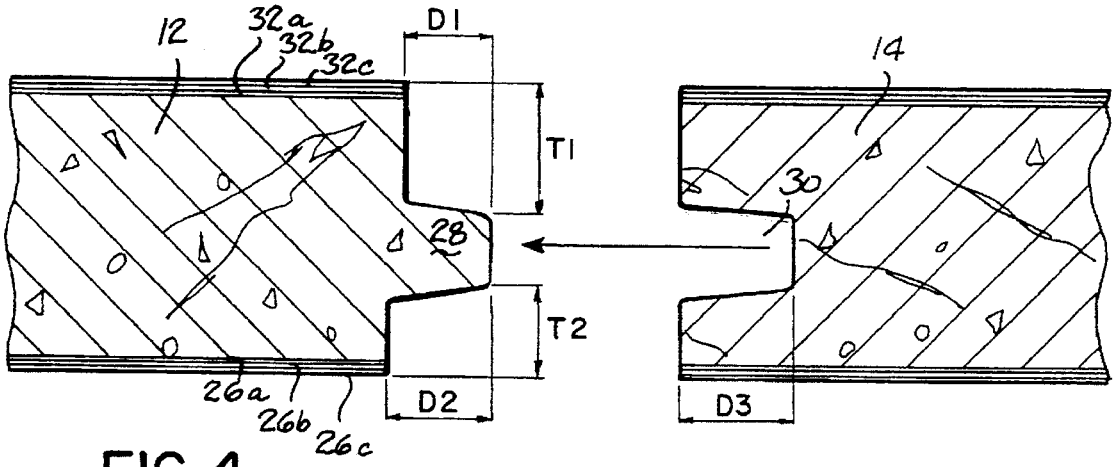
FIGS. 4 and 5 are cross-sectional views showing the tongue and groove configuration of adjacently located panels of a mezzanine floor, in accordance with a preferred embodiment of the invention.
Figure 5:
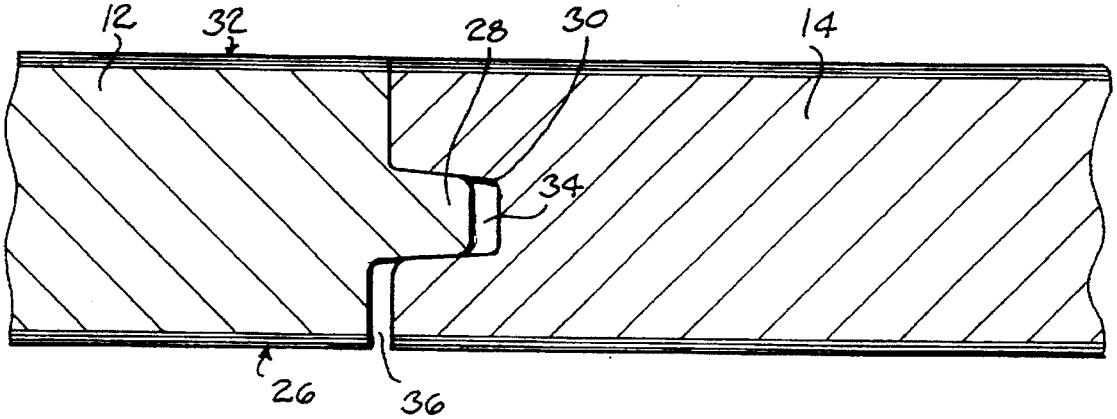

After the above-described surface treatment of the panels 12, the panels 12 are run through a fletcher machine (not shown) to cut tongues and grooves into the longitudinal edges thereof. FIGS. 4 and 5 show, in cross-section, a tongue 28 and a groove 30 in adjacently located panels 12 and 14. These figures show that the dimension $D_1$ along the top surface of the tongue 28 is less than the dimension $D_2$ along the bottom surface of the tongue 28, and also that the vertical dimension $T_1$ above the tongue 28 is greater than the vertical dimension $T_2$ located below the tongue 28. Thus, the tongue 28 is offset below the vertical midpoint of the panel 12, and the tongue 28 is also horizontally offset because of the unequal dimensions of its top and bottom surfaces. Preferably, the tongue 28 is slightly tapered, as shown in the drawings.

As shown in FIG. 5, when joined, there is some open space 34 between the end of the tongue 28 and the groove 30, and some open space 36 between the panels 12 and 14 below the tongue 28. The groove 30 preferably has a depth $D_3$ greater than $D_1$ to provide for gap 34. Although not shown in the drawings, there is also some slight spacing between the adjacent panels 12 and 14 above the tongue 28.

This spacing is equal in dimension to the width of a credit card, and it is maintained at an initial installation because of the inherent susceptibility of wood-based composite boards to expansion and contraction caused by moisture.

Figure 3:
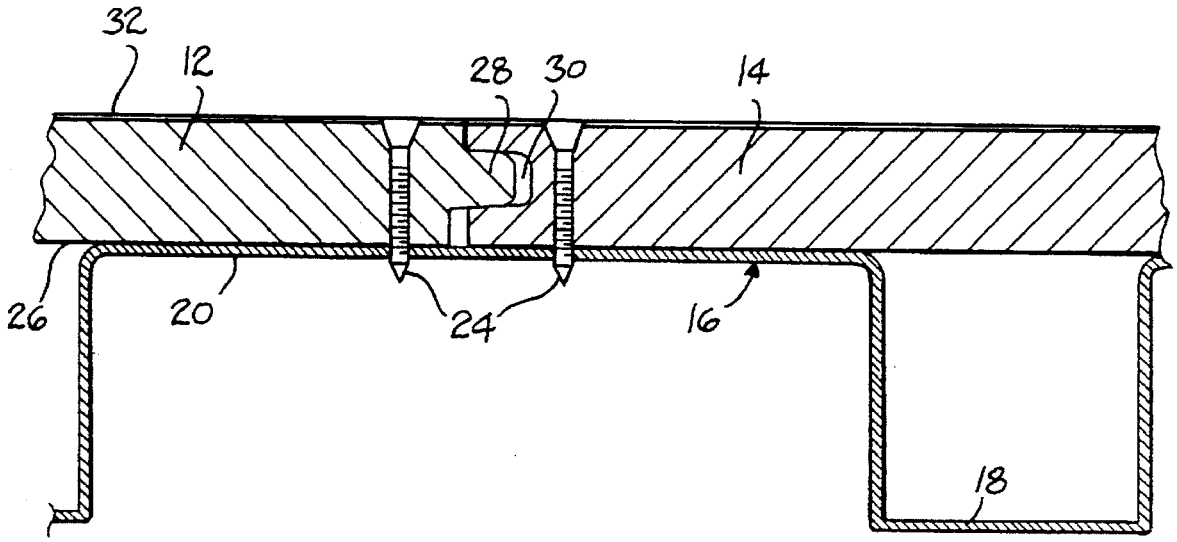
FIG. 3 is a cross-sectional view taken along lines 3—3 of FIG. 1.

As shown best in FIG. 3, at the job site, the panels are fastened to the corrugated metal 16 via screws 24. Because of the high internal cohesiveness and surface hardness of the panels of this invention, in combination with the durable coating achieved through the above-described finishing steps, the panels 12 may be secured to the corrugated metal 16 with screws 24 which have relatively small heads, compared to large head screws previously required with prior panels for mezzanine floors. For the prior mezzanine floors, the enlarged screw head provided the holding power to secure the panels in place. However, with the composition and surface characteristics of the panels 12 of this invention, the same magnitude of surface holding force at the top end of the screws 24 is not necessary, because the holding force result from the interaction of the shaft of screws 24 and panel 12.

This results in an additional benefit in installing the panels 12. More specifically, the steeper angle of the reduced size head of the screws 24 enables the screws 24 to be more readily extended downwardly through the panels 12 and into the corrugated metal 16. Due to building code requirements, and for obvious safety reasons, it is necessary to recess the tops of the screws 24 at or below the surface of the panels 12. This can be extremely difficult with larger headed screws, with a shallower angle of support structure. For some prior screws, complete installation required the additional step of counterboring the panels prior to installing the screws. Thus, with the panels 12 of this invention, there is no need to counterbore the panels prior to installation of the screws 24, and installation of the screws 24 is facilitated.

According to a second preferred embodiment for installing the panels 12, the holding screws 24 are eliminated altogether, and the panels 12 are secured to the corrugated metal 16 by adhesive (not shown). This manner of securement was not feasible with previous mezzanine panels, primarily because of their susceptibility to eventual flaking or delamination. Such deterioration of the upper portions of the panels leaves the bottom portions still secured to the corrugated layer, and these bottom portions can only be removed with labor intensive scraping, chiselling or prying. However, because of the textured surface provided by the finishing steps of this invention, the composition of the board, and the structural stability at the joints provided by the tongue and groove configuration, the susceptibility of the panels 12 to flaking or deterioration at or near the upper surface is virtually eliminated. As a result, the panels 12 may be bonded to the corrugated layer 16.

In a preferred manner of bonding the panels 12 to the corrugated layer 16, an epoxy is used, preferably an epoxy supplied by 3M under the designation "DP460". Preferably the epoxy is applied in an amount of about 0.25 ounces per square foot, and the glue is applied to every flat upper portion 20 of the corrugated layer 16. This epoxy includes two components, an accelerator and a base, and they are preferably kept in separate compartments of a portable box-shaped cart, at a temperature preferably in the range of 85° to 90° F. The two components are brought together in a mixing nozzle which feeds an adhesive gun, and the gun is used to control pressurized dispensing onto the corrugated layer 16.

Applicant has tested the structural integrity of the mezzanine floor wherein the panels 12 are glued to the corrugated layer 16, and the results show that, with this epoxy, it takes 330 pounds per square inch to pull the panel 12 off of the corrugated layer 16.

While these and other features of a preferred method for finishing method for mezzanine floor panel have been described, including several variations thereof, it is to be understood that the invention is not limited thereby and in light of the present disclosure, various other alternative embodiments will be apparent to one of ordinary skill in the art without departing from the scope of the invention. For instance, the number of additional acrylic coatings may be varied, and the viscosity ranges for these additional acrylic coatings and the final acrylic coating may also be varied, so long as a desired degree of non-skid characteristic is achieved. Also, if desired, various pigments may be added to the additional or final acrylic coatings, to achieve a finished mezzanine floor panel 12 with a desired color. Accordingly, applicant intends to be bound only by the following claims.

We claim:

1. A mezzanine floor panel comprising:

a board of predetermined dimension having a homogeneous composition comprising wood fibers, phenolic resin and wax emulsion, the board having longitudinal and side edges defining first and second surfaces;

each of the first and second surfaces including at least one layer of polyester acrylic covered by at least one layer of acrylic, wherein on at least one of the surfaces an outermost of the acrylic layers has a stippled texture; and a tongue located along a first of the edges and a complementary shaped groove located along an edge opposite the first edge, the tongue having upper and lower surfaces unequal in dimension.

2. The mezzanine floor panel of claim 1, made in accordance with the following method steps:

a) coating the first surface of the panel with a first layer of polyester acrylic;

b) curing the first layer;

c) coating the first surface with at least one additional layer of acrylic;

d) semi-curing the at least one additional layer of acrylic;

e) coating the first surface with a final layer of acrylic, including varying the viscosity of the final layer to an amount lower than the viscosity of the last layer of acrylic coated in step c); and f) curing the final layer of acrylic and all previously coated layers.

3. A mezzanine floor for a building comprising:

a layer of corrugated metal adapted to be secured to the building in substantially horizontal disposition;

a plurality of panels secured to the corrugated metal to provide a uniform mezzanine floor surface, each of the panels comprising a homogeneous composition of wood fibers, phenolic resin and wax emulsion; and each of the panels having upper and lower surfaces and each of the upper and lower surfaces including an outer layer of cured acrylic, each of the upper surfaces having a textured finish.

4. The mezzanine floor of claim 3 wherein each of the panels has four edges; and a tongue located along a first of the edges and a complementary shaped groove located along an edge opposite the first edge, the tongue having upper and lower surfaces unequal in dimension.

5. The mezzanine floor of claim 3 wherein the panels are secured to the corrugated metal by screws.

6. The mezzanine floor of claim 3 wherein the panels are secured to the corrugated metal by adhesive.

* * * * *